US006418703B1

(12) United States Patent
Yamamoto

(10) Patent No.: US 6,418,703 B1
(45) Date of Patent: Jul. 16, 2002

(54) METHOD AND APPARATUS FOR OPENING A CASE AND FORMING AN INSERTION SPACE THEREIN

(75) Inventor: Kaoru Yamamoto, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/611,458

(22) Filed: Jul. 7, 2000

(30) Foreign Application Priority Data

Mar. 30, 2000 (JP) ..... 2000-094649

(51) Int. Cl.[7] ..... B65B 43/48

(52) U.S. Cl. ..... 53/564; 53/473; 53/474; 53/492

(58) Field of Search ..... 53/564, 492, 238, 53/381.6, 381.1, 474, 473; 493/374, 375

(56) References Cited

U.S. PATENT DOCUMENTS 4,201,027 A * 5/1980 Ilsemann ..... 53/538
4,934,892 A * 6/1990 Smith ..... 53/386
5,479,760 A * 1/1996 Petrell ..... 53/238
5,664,405 A * 9/1997 Perego ..... 53/492
6,048,158 A * 4/2000 Zaniboni ..... 53/492
6,233,909 B1 5/2001 Onishi

FOREIGN PATENT DOCUMENTS

JP 2001-48118 2/2001

* cited by examiner

*Primary Examiner*—Rinaldi I. Rada
*Assistant Examiner*—Gloria R. Weeks
(74) *Attorney, Agent, or Firm*—W. F. Fasse; W. G. Fasse

(57) ABSTRACT

A case developing machine 1 comprises a case unloading device 3 that unloads a closed case 10 from a case stacking station 2, a case opening device 4 that opens and develops an unloaded case 10, and an insertion space forming device 5 that forms an insertion space of rhombic cross section for a title sheet between a case body 11 and a cover 12. The case opening device 4 includes a suction cup 47 holding the back of a case 10, at least one pair of suction cups 43, 44 holding the front face and the rear face of a case 10, respectively, and a pair of claw members 45, 46 engaging with the end face of a case body 11. The insertion space forming device 5 includes a pair of contact members 51 that maintain the opened case body 11 in the reversed V-shaped cross section, and a suction cup 52 that maintains the cover 12 in the general V-shaped cross section.

7 Claims, 7 Drawing Sheets

METHOD AND APPARATUS FOR OPENING A CASE AND FORMING AN INSERTION SPACE THEREIN

TITLE OF THE INVENTION

Method of developing case and apparatus for developing same

BACKGROUND OF THE INVENTION

The present invention relates to the field of automated packaging, and more specifically, to a method of or an apparatus for developing an openable and closable plastic case for an optical disk such as CD (i.e. Compact Disk), DVD (i.e. Digital Video Disk) or the like.

A case for an optical disk generally has an openable case body. An optical disk is loaded into one side of the case body and a description sheet is inserted into the other side of the case body. On the front face of the case body is provided a transparent cover for inserting a title sheet.

Conventionally, as there were no automated packaging machines to load an optical disk and insert a title sheet into a case, these loading and inserting operations were performed by hand, which was very troublesome.

The solution to this problem is identified in Onishi, Japanese patent application No. 11-217277, published on Feb. 20, 2001 as JP 2001-48118A. As shown in Onishi, an automated optical disk loading machine is provided where loading of an optical disk and inserting of a title sheet can be automatically conducted.

In operation, as a case conveyor conveys a plurality of cases supplied by a case supplying device at a case stacking station, a case opening device opens a closed case, a suction cup holding the opened case body moves downwardly to form a title sheet insertion space between the case body and the cover, and thereafter, a title sheet inserting device inserts a title sheet into the insertion space of the case body, and an optical disk loading device loads an optical disk into the case body.

In the above-mentioned machine, however, a case opening process and an insertion space forming process are performed while a case is carried by a case conveyor. As a result, the whole machine is made longer in the case carrying direction and becomes larger in size.

The main object of the present invention is to reduce the size of the whole apparatus.

SUMMARY OF THE INVENTION

The present invention is directed to a method of or an apparatus for developing a case, which is formed of an openable or foldable case body and a cover attached on the outside face of the case body.

The method of developing a case includes the steps comprising:

(i) unloading the case from a case stacking station that has a plurality of closed cases stacked thereat, (ii) opening the unloaded, closed case by a pair of claw members and developing or spreading open the case by a pair of suction cups, with the suction cups holding the front face and the rear face of the case and with the hinge of the case supported upwardly.

(iii) forming a title sheet insertion space of rhombic cross section between the case body and the cover by holding both the end faces of the developed case body and maintaining the case body in the flat, reversed V-shaped cross section and the cover in the general V-shaped cross section, (iv) each of the above processes is performed by transferring the case in essentially the same vertical plane.

The apparatus for developing a case includes a case unloading device that unloads a case from a case stacking station with a plurality of closed cases stacked thereat. The apparatus also includes a case opening device having a first suction cup movable in the vertical direction, second and third suction cups swingable in the upward and downward directions, and a pair of claw members. The first suction cup holds the hinge of the unloaded, closed case, and the second and third suction cups hold the front and rear faces of the closed case, respectively. The claw members engage with the end face of the case body and unlock the closed case body. The apparatus further includes an insertion space forming device for forming an insertion space of rhombic cross section between the case body and the cover. The insertion space forming device has a pair of contact members and a fourth suction cup. The contact members contact with both the end faces of the developed case body and maintain the case body in the flat, reversed V-shaped cross section. The fourth suction cup maintains the cover in the general V-shaped cross section. The case developing operation by the case unloading device, the case opening device and the insertion space forming device is performed by transferring the case in essentially the same vertical plane.

Preferably, the second and third suction cups and the claw members are fitted on a pair of swingable levers.

The case developing apparatus may further include a case transferring device, which transfers a case formed with the insertion space toward a title sheet to be inserted into the insertion space.

In the case developing method of the present invention, after a closed case is unloaded from the case stacking station, the back of a case is supported upwardly and the front face and the rear face of the case are held by the suction cups. Thereafter, the case body is opened by the claw member, and the case is developed by the swing of the suction cups.

Then, with both the ends of the developed case body supported, the case body maintains a flat, reversed V-shape in cross section, and the cover maintains a general V-shape in cross section. In such a way, a title sheet insertion space of rhombic cross section is formed between the case body and the cover.

According to this case developing method, each of the aforementioned processes is performed by transferring the case in substantially the same vertical plane without carrying the case toward the end of the conveyor. As a result, the whole machine can be made smaller in size without becoming longer in the case carrying direction.

In the case developing machine of the present invention, the case unloading device unloads a closed case from the case stacking station. The unloaded case is placed on the case opening device. The first suction cup holds the back of the case upwardly, and the second and third suction cups hold the front and rear faces of the case, and thereafter, a pair of claw members unlock the case. Then, the case is opened and developed by the swing of the second and third suction cups.

Then, the contact members contact with both the end faces of the developed case body and maintain the case body in a flat, reversed V-shaped cross section. The fourth suction cup maintains the cover in the general V-shaped cross section. Thus, a title sheet insertion space of rhombic cross section is formed between the case body and the cover.

According to this case developing machine, the case developing operation is performed by transferring the case in substantially the same vertical plane without carrying the case toward the end of the conveyor. Thereby, the whole machine is not made larger in the case conveying direction but made smaller in size.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 6:
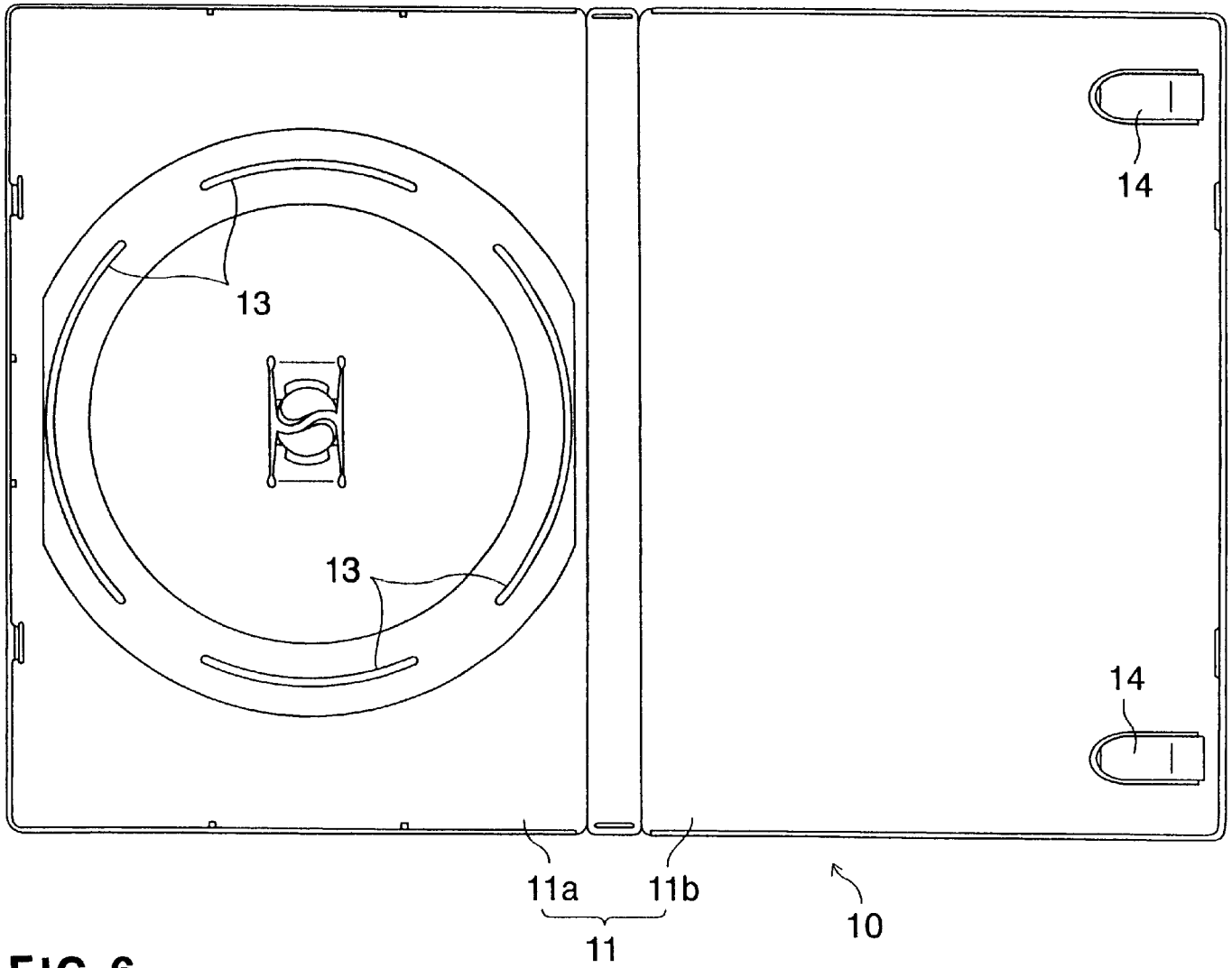
FIG. 6 is a top plan view of a case in a developed condition.
Figure 7:
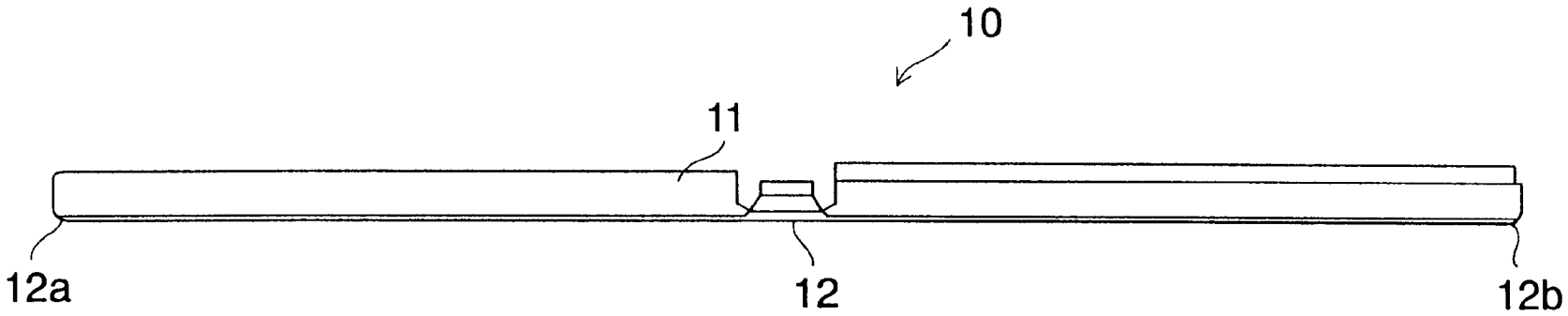
FIG. 7 is a side view of a case in a developed condition.

Referring now to the drawings, FIGS. 6 and 7 illustrate a case which is used in the case developing method of the present invention. As shown in FIGS. 6 and 7, a case 10 has a foldable or openable, box-shaped case body 11 and a cover 12 attached on the front side of the case body 11. On one side 11*a* of the case body 11 is formed a plurality of ridge portions 13 extending circumferentially. These ridge portions 13 form a loading hole for an optical disk (not shown). On the other side 11*b* of the case body 11 are provided a pair of holding claws 14 to hold a description for the optical disk. Both ends 12*a* and 12*b* of the cover 12 are heat-sealed to the end portions of the body portions 11*a*, 11*b* of the case body 11.

Figure 1:
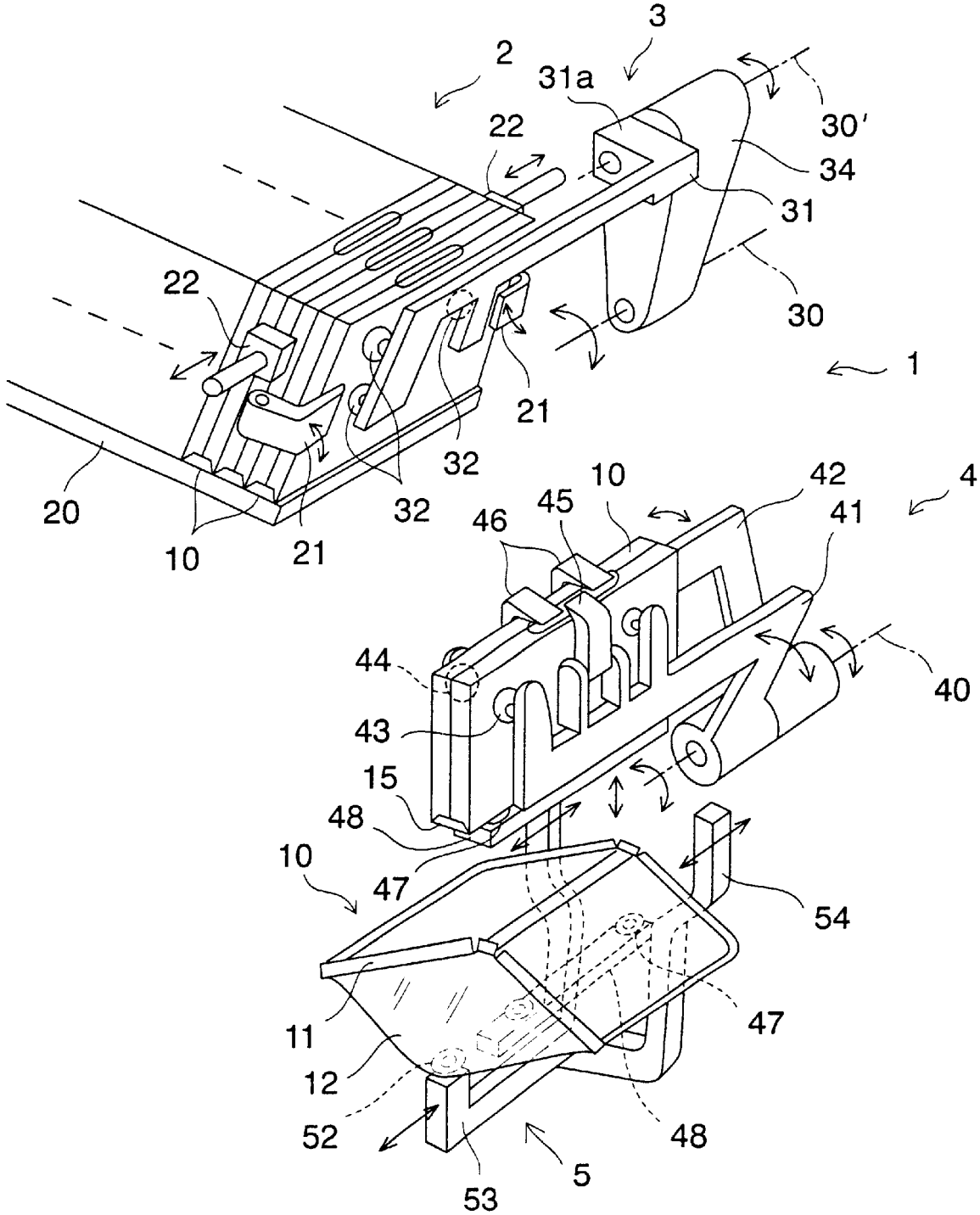
FIG. 1 is a schematic illustrating the whole construction of the case developing machine of one embodiment of the present invention and also illustrating the case developing method of the machine.
Figure 2:
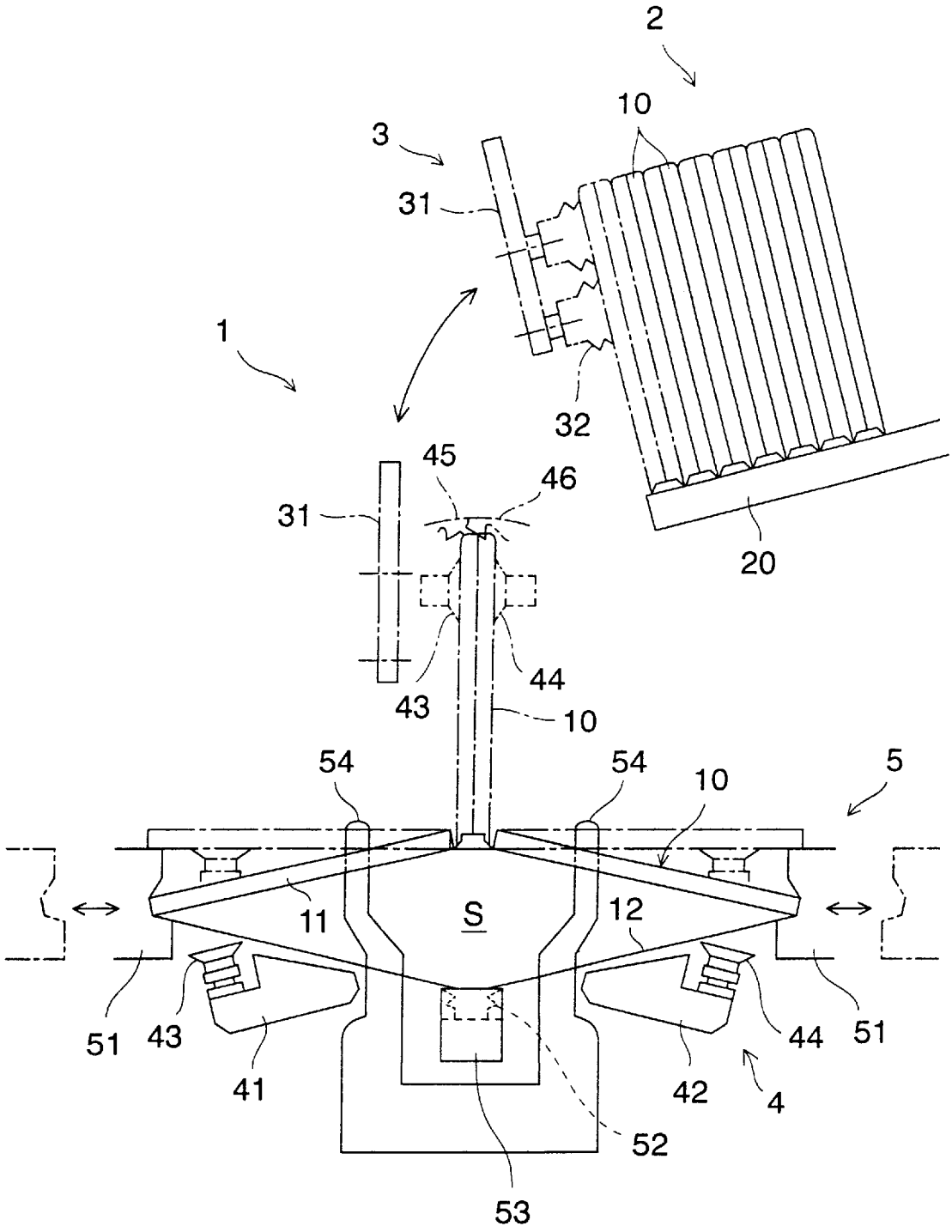
FIG. 2 is a side schematic view of the case developing machine of FIG. 1.

As shown in FIGS. 1 and 2, a case developing machine 1 includes a case stacking station 2 where a plurality of folded or closed cases 10 are stacked, a case unloading device 3 for unloading a closed case 10 from the case stacking station 2, a case opening device 4 for unlocking the unloaded, closed case 10 and opening and developing the case 10, and an insertion space forming device 5 for forming a title sheet insertion space S in the case 10 by deforming the developed case body 11 into the flat, reversed V-shape in cross section and maintaining the cover 12 in the general V-shaped cross section.

At the case stacking station 2, shown in FIG. 1, is provided a base 20 where a plurality of cases 10 are stacked in the inclined direction. Also, at the case stacking station 2, are also provided a pair of stoppers 21 and brake pads 22 for preventing a case 10 from falling down from the base 20. Each of the stoppers 21 is generally L-shaped and swingable in the arrow mark direction. Each of the brake pads 22 is movable in the arrow mark direction and presses against the end face of a case 10.

The case unloading device 3, shown in FIG. 1, has a bracket 34 swingable around the axis 30, which is placed at one end of the bracket 34. At the other end of the bracket 34 is attached a proximal end 31*a* of an arm 31 swingable around the axis 30'. Suction cups 32 are provided at the distal end of the arm 31 to hold a case 10. The arm 31 can take the holding position for holding a case 10 by suction cups 32 at the case stacking station 2 (see the solid line of FIG. 1 and the dashed line of FIG. 3), and the transferring position for transferring a case 10 held by the suction cups 32 to the case opening device 4 (see the solid line of FIG. 3).

Figure 3:
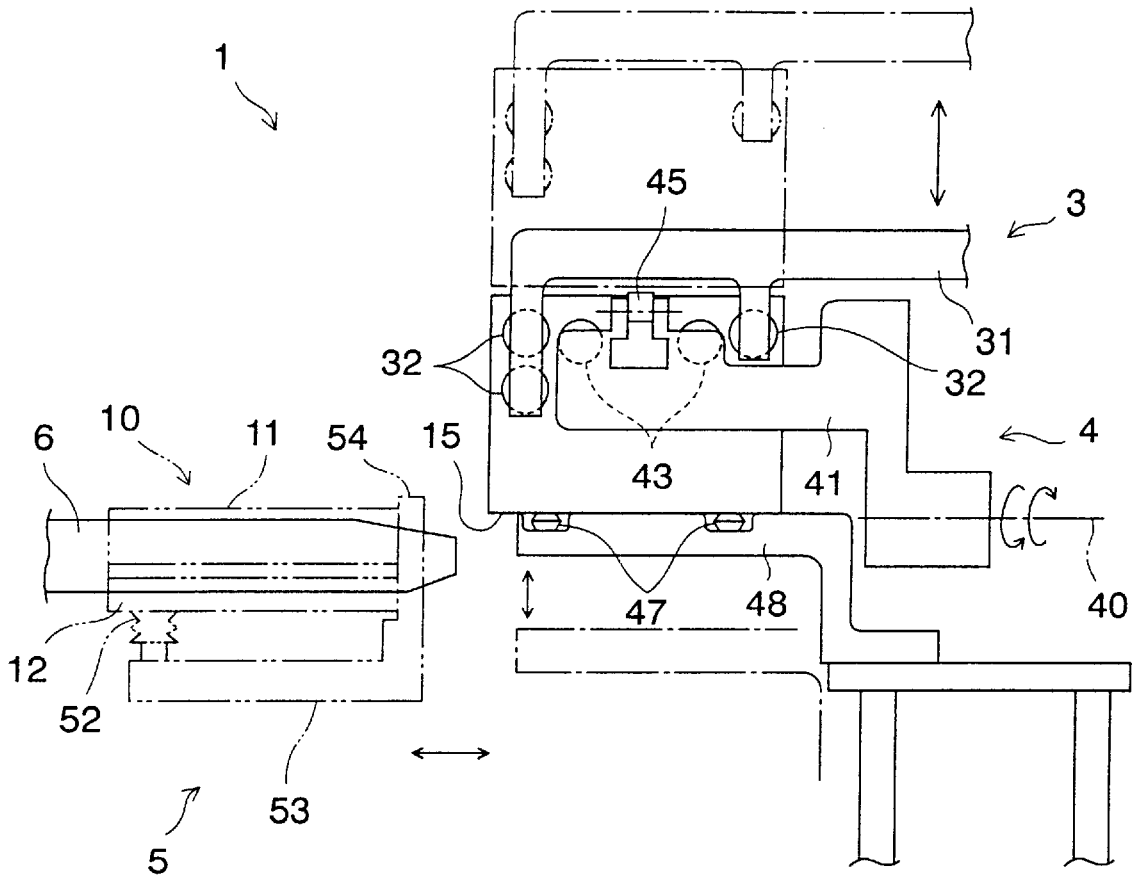
FIG. 3 is a front elevational schematic view of the case developing machine of FIG. 1.

The case opening device 4, shown in FIGS. 1–3, has a pair of levers 41, 42 swingable around the axis 40. The levers 41 and 42 are provided with suction cups 43, 44, respectively, for holding a case 10. The levers 41 and 42 are also provided with claw members 45, 46, respectively, to engage with the end face of the closed case body 11 and to unlock the case body 11. The case opening device 4 further has a suction cup 47 holding the back 15 of a case 10 upwardly. The suction cup 47 is attached on the member 48 movable in the upward and downward directions.

The insertion space forming device 5, shown in FIG. 2, has a pair of horizontally translatable contact members 51 contacting with and supporting the opposite ends of the developed case body 11, and a suction cup 52 holding the cover 12 of a case 10. The suction cup 52 is fitted on the horizontally movable member 53, shown in FIGS. 1 and 3. There is also provided a pair of horizontally translatable rods 54 adapted to contact with the ends of the developed case body 11.

Now, the case developing method by the aforementioned case developing machine will be described hereinafter.

First, when unloading a case 10 stacked at the case stacking station 2, the arm 31 of the case unloading device 3 travels to the holding position, and the suction cups 32 hold the first case 10 in the row on the base 20 (see FIG. 1), and then, the stoppers 21 pressed against the front face of the case 10 release the case 10 by the swinging movement of the stoppers 21.

Then, the rotational movement of the bracket 34 around the axis 30 causes the swinging movement of the arm 31 around the axis 30' and the arm 31 travels to the transferring position (see the solid line of FIG. 3). Thus, a case 10 is unloaded from the case stacking station 2 and the unloaded case 10 is transferred to the case opening device 4 with the case body 11 in the standing position.

In the case opening device 4, the back 15 of the case 10 is supported and held by the suction cup 47 and the front and rear faces of the case 10 are held by the suction cups 43, 44 of the levers 41, 42. Also, a pair of claw members 45, 46 engage with the end face of the case body 11 (see FIGS. 1 and 3).

In this condition, when the levers 41, 42 swing downwardly around the axis 40, the suction cups 43, 44 and the claw members 45, 46 also swing downwardly along with the levers 41, 42. As a result, the claw members 45, 46 unlock the case body 11, and the suction cups 43, 44 open and develop the case 10 (see FIG. 2).

Then, the case body 11 deforms into a flat, reversed V-shaped cross section. Also, at the time of downward movement of the suction cups 43, 44 and the claw members 45, 46, the suction cup 47 travels downwardly by the downward movement of the member 48 (see the dashed line of FIG. 3). Thus, the cover 12 deforms into a general V-shape in cross section. In such a manner, a title sheet insertion space S of rhombic cross section is formed between the case body 11 and the cover 12 (see FIGS. 1 and 2).

According to the case developing method of one embodiment of the present invention, the case developing operation is performed by transferring a case in essentially the same vertical plane without conveying a case toward the end of the conveyor, as shown in FIGS. 2 and 3. Thus, the case developing machine 1 is not made larger in the lateral direction of FIG. 3, and the whole machine can be made smaller in size.

Moreover, in this embodiment, unlocking of the case body 11 and opening of the case 10 are conducted by simply rotating the levers 41, 42. Thus, the structure of the case opening device 4 can be simplified.

Next, each of the contact members 51 of the insertion space forming device 5 contact with and support the opposite ends of the case body 11, and the suction cup 52 holds the cover 12. Then, by the movement of the rod 54, the case 10 is transferred toward a title sheet (not shown) to be inserted into the insertion space S.

Figure 4:
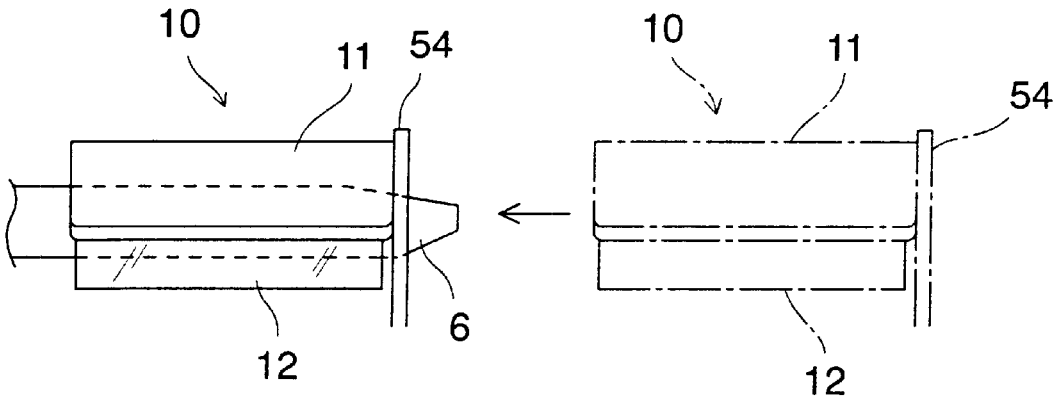
FIGS. 4 and 5 are schematics illustrating the title sheet insertion process.
Figure 5:
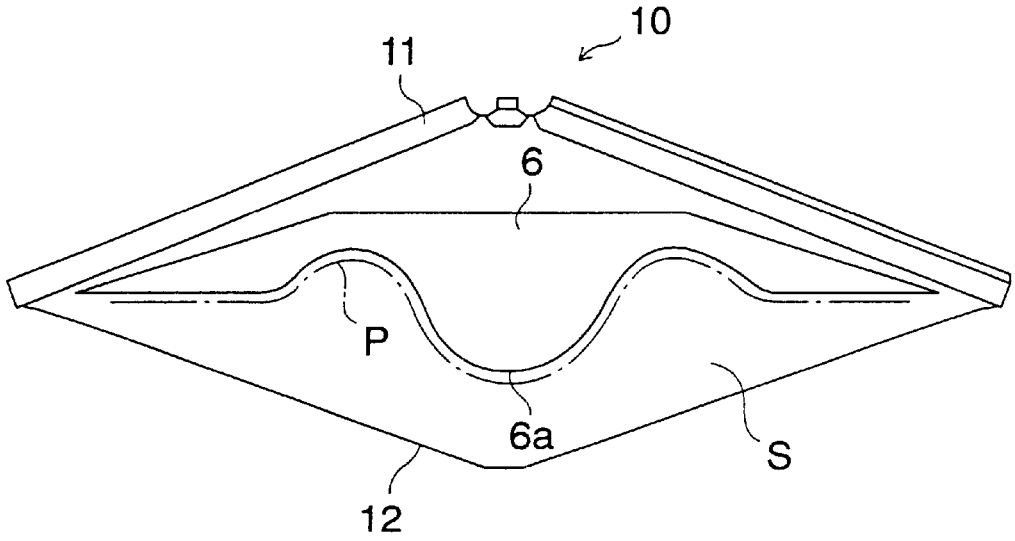

At the time of the movement of the rod 54, shown in FIG. 5, the title sheet P is held on the corrugated face 6*a* of the cope 6. When the rod 54 advances, the title sheet P along with the cope 6 is inserted into the insertion space S of the case 10, shown in FIG. 4.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. An apparatus for developing a case, said case having an openable and closeable case body with a hinge and a cover attached on outside front and rear faces of said case body, said apparatus comprising:

a case unloading device adapted to unload said case from a case stacking station with a plurality of closed cases stacked at said case stacking station;

a case opening device having a first suction cup movable in a vertical direction, second and third suction cups swingable in upward and downward directions, and a pair of claw members, said first suction cup adapted to hold said hinge of said case that has been unloaded from said case stacking station, said second and third suction cups adapted to hold said front and rear faces of said case, respectively, said claw members adapted to engage with two end faces of said case body and unlock said case body from a closed condition; and an insertion space forming device for forming a rhombic insertion space having a rhombic cross section between said case body and said cover, said insertion space forming device having a pair of contact members and a fourth suction cup, said contact members being adapted to contact the two end faces of said case body after it has been opened and to maintain said case body in a flat, reversed V-shaped cross section, and said fourth suction cup being adapted to maintain said cover in a V-shaped cross section, wherein said case unloading device, said case opening device and said insertion space forming device are adapted to transfer said case in substantially one same vertical plane.

2. The apparatus of claim 1, wherein said case opening device further comprises a pair of swingable levers, and wherein said second and third suction cups and said claw members are fitted on said pair of swingable levers.

3. The apparatus of claim 2, further comprising a case transferring device, said case transferring device adapted to transfer said case formed with said insertion space toward a title sheet to be inserted into said insertion space.

4. The apparatus of claim 1, further comprising a case transferring device, said case transferring device adapted to transfer said case formed with said insertion space toward a title sheet to be inserted into said insertion space.

5. A method of using the apparatus according to claim 1 for developing said case, said method comprising the following steps:

a) unloading said case from said case stacking station using said case unloading device;

b) after said step of unloading said case, then unlocking and opening said case using said pair of claw members and further opening said case using said second and third suction cups, with said second and third suction cups holding said front face and said rear face of said case while said hinge of said case is supported upwardly; and c) forming said rhombic insertion space having said rhombic cross section between said case body and said cover by holding said two end faces of said case body using said two contact members, and maintaining said case body in said flat, reversed V-shaped cross section, and maintaining said cover in said V-shaped cross section using said fourth suction cup;

wherein each of said steps a), b) and c) are performed by transferring said case in substantially said one same vertical plane.

6. An apparatus for opening a storage case including two case body portions pivotally connected to each other along a spine edge by a hinge, and a cover loosely arranged on said spine edge and on first and second outside faces of said two case body portions and secured to said case body portions at first and second free edges of said case body portions opposite said spine edge, said apparatus comprising:

first means for unloading said storage case in a closed condition from a stacking station into an unloaded position;

second means for engaging said storage case at said unloaded position and opening said case, including a first suction cup for suction-holding said cover at said spine edge of said storage case from below with said spine edge oriented downwardly and said free edges oriented upwardly, first and second mechanical claw members for engaging said first and second free edges and beginning to open said storage case from said closed condition by pivoting said case body portions apart from each other about said hinge, and second and third suction cups for suction-holding said cover at said first and second outside faces of said two case body portions and continuing to open said storage case by pivoting said case body portions apart from each other about said hinge past a flat horizontal orientation into an open condition in which said case body portions form an inverted V-shaped cross-section with said free edges pivoted downward below said spine edge; and third means for forming a sheet insertion space having a rhombic cross section between said case body portions and said cover, including two mechanical contact members for mechanically engaging and holding said free edges of said case body portions in said open condition, and a fourth suction cup for suction-holding said cover downwardly away from said spine edge so as to form said sheet insertion space having said rhombic cross-section between said case body portions and said cover.

7. An apparatus for opening a storage case including two case body portions pivotally connected to each other along a spine edge by a hinge, and a cover loosely arranged on said spine edge and on first and second outside faces of said two case body portions and secured to said case body portions at first and second free edges of said case body portions opposite said spine edge, said apparatus comprising:

first and second pivot arms that are pivotable relative to each other about a horizontal pivot axis, symmetrically as to a vertical plane, first and second suction cups that are respectively mounted on said first and second pivot arms and that are respectively positioned and adapted to suction-hold said cover at said first and second outside faces of said two case body portions;

first and second claws that are respectively mounted on said first and second pivot arms and that are respectively arranged and adapted to mechanically engage said first and second free edges of said case body portions;

a spine support suction cup that is positioned on said vertical plane and adapted to suction-hold from below said spine edge of said storage case covered with said cover;

first and second mechanical contact members that are arranged symmetrically on opposite sides of said vertical plane at positions laterally outside of pivot arcs of said first and second suction cups mounted on said pivot arms, and that are respectively adapted to mechanically contact and support said first and second free edges of said case body portions at locations below an elevation of said spine edge on said vertical plane so that said case body portions form an inverted V-shape; and a cover holding suction cup that is arranged on said vertical plane and that is adapted to suction-hold said cover downwardly away from said spine edge of said case body so as to form a space having a rhombic cross-sectional shape between said cover and said case body portions.

* * * * *

UNITED STATES PATENT AND TRADEMARK OFFICE

CERTIFICATE OF CORRECTION

PATENT NO. : 6,418,703 B1
DATED : July 16, 2002
INVENTOR(S) : Yamamoto

It is certified that error appears in the above-identified patent and that said Letters Patent is hereby corrected as shown below:

Column 1,
Lines 5, 6 and 7, delete the following:
"TITLE OF THE INVENTION
Method of developing case and apparatus for developing same".

Column 6,
Line 5, after "claim" replace "2," by -- 1 , --.

Signed and Sealed this

Twenty-second Day of October, 2002

*Attest:*

*Attesting Officer*

JAMES E. ROGAN
*Director of the United States Patent and Trademark Office*